US007834887B2

(12) United States Patent
Xu et al.

(10) Patent No.: US 7,834,887 B2
(45) Date of Patent: Nov. 16, 2010

(54) METHODS AND SYSTEMS FOR COMBINING LUMINANCE PRESERVING QUANTIZATION AND HALFTONING

(75) Inventors: Ning Xu, Irvine, CA (US); Yeong-Taeg Kim, Irvine, CA (US)

(73) Assignee: Samsung Electronics Co., Ltd., Suwon (KR)

( * ) Notice: Subject to any disclaimer, the term of this patent is extended or adjusted under 35 U.S.C. 154(b) by 1232 days.

(21) Appl. No.: 11/099,710

(22) Filed: Apr. 5, 2005

(65) Prior Publication Data

US 2006/0221095 A1 Oct. 5, 2006

(51) Int. Cl.
*G09G 5/02* (2006.01)

(52) U.S. Cl. ..... 345/597; 345/596; 382/166; 382/167; 382/251

(58) Field of Classification Search ..... 345/596, 345/597; 382/166–167, 251
See application file for complete search history.

(56) References Cited

U.S. PATENT DOCUMENTS

| | | | | |
|---|---|---|---|---|
| 5,995,671 | A * | 11/1999 | Nagarajan et al. | 382/242 |
| 6,133,902 | A * | 10/2000 | Ohkubo et al. | 345/690 |
| 6,266,157 | B1 * | 7/2001 | Fan et al. | 358/1.9 |
| 6,721,455 | B1 * | 4/2004 | Gourdol | 382/232 |
| 7,038,814 | B2 * | 5/2006 | Huovinen | 358/1.9 |
| 7,206,001 | B1 * | 4/2007 | Crandall et al. | 345/596 |
| 7,298,525 | B2 * | 11/2007 | Hagai et al. | 358/1.9 |
| 2004/0081354 | A1 * | 4/2004 | Mojsilovic et al. | 382/162 |
| 2004/0120594 | A1 * | 6/2004 | Vitali et al. | 382/251 |
| 2005/0128496 | A1 * | 6/2005 | Bala | 358/1.9 |
| 2005/0174360 | A1 * | 8/2005 | Daly et al. | 345/596 |
| 2006/0098885 | A1 | 5/2006 | Xu et al. | 382/164 |
| 2006/0152763 | A1 * | 7/2006 | Chen et al. | 358/3.03 |
| 2006/0177143 | A1 * | 8/2006 | Winger | 382/251 |

OTHER PUBLICATIONS

J. Jarvis, C. Judice, and W. Ninke, "A survey of techniques for the display of continuous tone pictures on bilevel displays," Computer Graphics and Image Processing, pp. 13-40, 1976, vol. 5.

R. Ulichney, Digital Halftoning. Cambridge, Mass.: The MIT Press, 1987.

R. W. Floyd and L. Steinberg, "An adaptive algorithm for spatial grey scale," in Proc. Soc. Inf. Display, 1976, pp. 75-77, vol. 17, No. 2.

(Continued)

*Primary Examiner*—Xiao M Wu
*Assistant Examiner*—Maurice McDowell, Jr.
(74) *Attorney, Agent, or Firm*—Kenneth L. Sherman, Esq.; Michael Zarrabian, Esq.; Myers Andras Sherman & Zarrabian LLP

(57) ABSTRACT

A color quantization or re-quantization method is provided that combines two dimensional halftoning with luminance preserving quantization (LPQ) for better perception results of high precision color video quantization. A combination of LPQ and error diffusion, and a combination of LPQ and spatial dithering, is provided. To combine LPQ and spatial dithering, the spatial dithering is regarded as a two-step processing, a mapping and a simple rounding. To combine LPQ and dithering together, a rounding step is replaced by the LPQ algorithm in the combination. Further a method is provided for post-processing which is applicable to both cases to reduce the color perception for grayscale image.

19 Claims, 8 Drawing Sheets

800

OTHER PUBLICATIONS

V. Ostromoukhov, "A simple and efficient error-diffusion algorithm," in Proceedings of SIGGRAPH 2001, pp. 567-572.
N. Damera-Venkata and B. Evans, "Design and analysis of vector color error diffusion halftoning systems," IEEE Trans. Image Processing, Oct. 2001, pp. 1552-1565, vol. 10, No. 10.
R. Adler, B. Kitchens, M. Martens, C. Tresser, and C. Wu, "The mathematics of halftoning," IBM Journal of Research and Development, 2003, pp. 5-15, vol. 47, No. 1.
J. Mulligan, "Methods for spatiotemporal dithering," SID 93 Digest, pp. 155-158, 1993.
C. Atkins, T. Flohr, D. Hilgenberg, C. Bouman, and J. Allebach, "Model-based color image sequence quantization," in Proceedings of SPIE/SI&T Conf. on Human Vision, Visual Processing, and Digital display V, Feb. 1994, pp. 310-317, vol. 2179, San Jose, CA.
R. Ulichney, "Dithering with blue noise," in Proceedings of IEEE, 1988, pp. 56-79, vol. 76.
B.E. Bayer, "An Optimum Method for Two-Level Rendition of Continuous-Tone Pictures," IEEE 1973 International Conference on Communications, Conference Record, vol. 1, Jun. 1973, pp. 26-11-26-15.

* cited by examiner

100

| | | |
|---|---|---|
| | * | $w(0,1)$ |
| $w(1,-1)$ | $w(1,0)$ | $w(1,1)$ |

Fig. 2

METHODS AND SYSTEMS FOR COMBINING LUMINANCE PRESERVING QUANTIZATION AND HALFTONING

FIELD OF THE INVENTION

The present invention relates in general to video and image processing, and in particular to color quantization or re-quantization of video sequences to improve the video quality for bit-depth insufficient displays.

BACKGROUND OF THE INVENTION

Real world scenes are colorful and usually contain continuous color shades. To perfectly reproduce these scenes on display devices, the displays have to have a broad enough dynamic range and a high accuracy. The 24-bit RGB color space is commonly used in virtually every computer system as well as in television systems, video systems, etc. In order to be displayed on these 24-bit RGB displays, images resulting from a higher precision capturing or processing system have to be first quantized to 3×8 bit RGB true color signals. Representing color data with more than eight bits per channel using these 8-bit displays, and maintaining the video quality at the same time, is a focus of the present invention.

There have been efforts in using less bit images to represent more bit images in printing community. Halftoning algorithms are used to transform continuous-tone images to binary images to be printed by either a laser or inkjet printer. Two categories of halftoning algorithms are primarily used: dithering and error diffusion. Both methods capitalize on the low pass characteristic of the human visual system and redistribute quantization errors to high frequencies that are less noticeable to a human viewer. The major difference between dithering and error diffusion is that the dithering makes decisions pixel-by-pixel based on the pixel's coordinate, whereas the error diffusion algorithm makes decisions on the basis of a running error. Therefore, for the hardware implementation of the halftoning algorithms, more memory is required for error diffusion than for the dithering.

At the same time, there is another characteristic of human visual system which can be applied to obtain better perception of shades. This is based on the fact that human vision is much more sensitive in luminance than in chrominance. This characteristic makes it possible to manipulate the quantized color signals so that we can preserve higher precision of luminance while keeping the difference of the chrominance signals within a tolerable range.

BRIEF SUMMARY OF THE INVENTION

The present invention addresses the above shortcomings. The present invention uses both characteristics of human visual system mentioned above. In one embodiment, the present invention combines two dimensional halftoning methods with luminance preserving quantization (LPQ) for better perception results of high precision color video quantization. Any two-dimensional halftoning method can be used. However, the methods for combining LPQ and error diffusion are different from those for combining LPQ and dithering. The present invention provides a combination of LPQ and error diffusion, and a combination of LPQ and spatial dithering. In order to combine LPQ and spatial dithering, the spatial dithering is regarded as a two-step processing, a mapping and a simple rounding. When combining LPQ and dithering together, the rounding step of dithering is replaced by the LPQ algorithm in the combination. Further a method is provided for post-processing which is applicable to both cases to reduce the color perception for grayscale image.

In one example implementation, the present invention provides a method of video processing, comprising the steps of: receiving a color signal comprising RGB of a pixel and its spatial and temporal positions; quantizing the RGB signal into a quantized RGB color signal having a predetermined quantization level as a function of halftoning and luminance preserving quantization; and outputting the quantized RGB color signal.

The step of quantizing the RGB signal into a quantized RGB signal having a predetermined quantization level further includes the steps of: quantizing a pixel's color value using luminance preserving quantization; and distributing quantization errors using error diffusion method. Alternatively, the step of quantizing the RGB signal into a quantized RGB signal having a predetermined quantization level further includes the steps of: mapping a pixel's color based on the corresponding threshold in the dithering mask; and quantizing the mapped color using luminance preserving quantization.

Other embodiments, features and advantages of the present invention will be apparent from the following specification taken in conjunction with the following drawings.

BRIEF DESCRIPTION OF THE DRAWINGS

FIG. 2 shows an example of typical filter coordinates that surround a pixel of interest.

DETAILED DESCRIPTION OF THE INVENTION

Halftoning algorithms developed for printing can also be used in representing more bit depth video using 8-bit video displays. In general, spatial dithering is applied to video quantization because it is both simple and fast. The fact that human vision is much more sensitive in luminance than in chrominance makes it possible to manipulate the quantized color signals to preserve higher precision of luminance while keeping the difference of the chrominance signals within a tolerable range In one embodiment, the present invention combines two dimensional halftoning methods with luminance preserving quantization (LPQ) for better perception results of high precision color video quantization. Any two-dimensional halftoning method can be used. However, the methods for combining LPQ and error diffusion are different from those for combining LPQ and dithering. The present invention provides a combination of LPQ and error diffusion, and a combination of LPQ and spatial dithering. Further a method is provided for post-processing which is applicable to both cases to reduce the color perception for grayscale image.

Error Diffusion

Error diffusion is one of the halftoning methods based on the human visual system's property of integrating information over spatial region. Human vision can perceive a uniform shade of color, which is the average of the pattern within the spatial region, even when the individual elements of the pattern can be resolved. The basic algorithm was first introduced by R. W. Floyd and L. Steinberg, "An adaptive algorithm for spatial grey scale," in *Proc. Soc. Inf. Display*, vol 17, no. 2, 1976, pp. 75-77, for halftoning in the printing process of gray scale image. In that algorithm, the quantization error for each pixel is calculated and fed forward to its neighboring pixels that are not quantized yet. This algorithm is shown to be equivalent to a feedback system that adjusts the current pixel's grayscale value by adding a weighted sum of the quantization errors of its quantized neighboring pixels. The objective of error diffusion is to preserve the average value of the image over local regions, such as a unity-gain lowpass filter.

Figure 1:
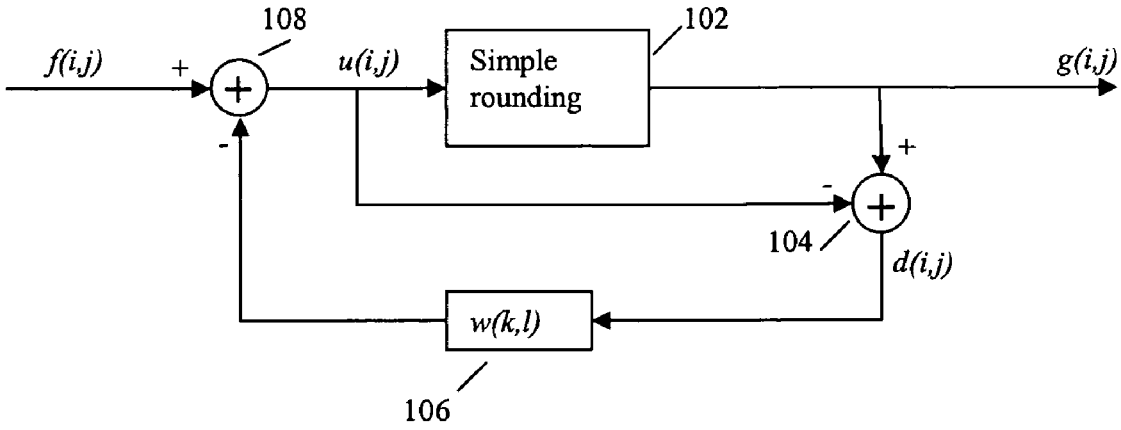
FIG. 1 shows an example of a typical error diffusion system.

To simplify description, an example error diffusion method with output to black and white is described. FIG. 1 shows the basic diagram of a typical error diffusion system 100. The input image to be halftoned is represented by an h×v matrix I of input gray levels I(i, j). A pixel value I(i, j) is first normalized to f(i,j) where $0 \leqq f(i,j) \leqq 1$. In FIG. 1, u(i,j) is the updated pixel value, and g(i,j) is the output halftoned value of 0 and 1, which is rounded from u(i,j) by a rounding block 102. The quantization error d(i,j) is computed by an adder 104 as:

$$d(i,j)=g(i,j)-u(i,j).$$

Then, the quantization error d(i,j) is distributed to it's neighboring pixels that are not processed yet, and the neighboring pixel's color value is updated using a w(k,l) weight block 106 and an adder 108 as:

$$u(i+k,j+l) \leftarrow u(i+k,j+l)-w(k,l)\cdot d(i,j),$$

with the weight w(k,l) shown by example in FIG. 2 (typical filter coordinates that surround a pixel of interest, which is marked with an asterisk). As can be seen in FIG. 2, the quantization error is distributed only to the pixels that are not processed yet.

Spatial Dithering

Figure 3:
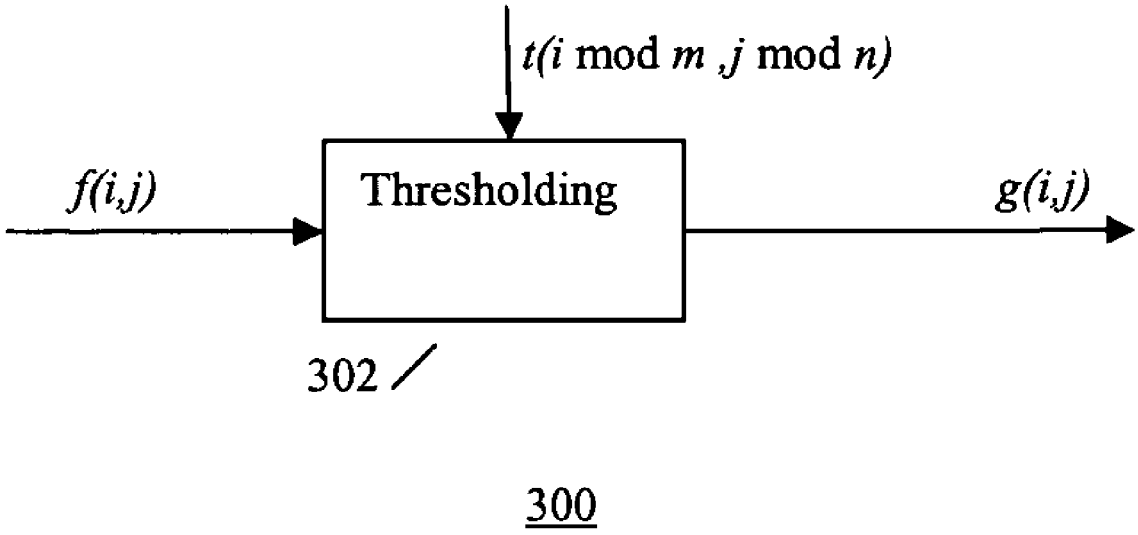
FIG. 3 shows an example system of spatial dithering, wherein the input value is thresholded by a threshold determined by its spatial position.

FIG. 3 shows an example block diagram for spatial dithering system 300, wherein an input value f(i,j) is thresholded by a Thresholding block 302, which is determined by its spatial position, to generate output value g(i,j). Spatial dithering is another method of rendering more depth than the capability of the display based on the human visual system's property of integrating information over spatial region. For simplicity of description, dithering to black and white is considered first. A dithering mask is defined by an n×m matrix M of threshold coefficients M(i, j). Usually, the size of dithering mask is much smaller than the size of input image, i.e. n,m<<h,v. The output image is a black and white image which contains only two levels, black and white. Representing black as 0 and white as 1, the output image O is represented by an h×v matrix of 0 and 1. The value of pixel O(i,j) is determined by the value I(i,j) and the dithering mask M as:

$$O(i,j)=\begin{cases}0, & \text{if } I(i,j)<M(i \bmod n,\ j \bmod m)\\ 1, & \text{otherwise.}\end{cases}$$

This black white dithering can easily be extended to multi-level dithering as those skilled in the art will recognize. Here, it is assumed the threshold coefficients of the dithering mask are between 0 and 1, i.e. 0<M(i,j)<1, and the gray levels of input image I are also normalized to between 0 and 1, i.e. $0 \leqq I(i,j) \leqq 1$. There are multiple quantization levels for the output image O such that each possible input gray level I(i,j) lies between a lower output level represented as $\lfloor I(i,j) \rfloor$ and an upper output level represented as $\lceil I(i,j) \rceil$. Here $\lfloor I(i,j) \rfloor$ is defined as the largest possible quantization level that is less than or equal to I(i,j), and $\lceil I(i,j) \rceil$ is defined as the next level that is greater than $\lfloor I(i,j) \rfloor$. Thus, the output O (i,j) of the dithering can be defined as:

$$O(i,j)=\begin{cases}\lfloor I(i,j) \rfloor, & \text{if } \dfrac{I(i,j)-\lfloor I(i,j) \rfloor}{\lceil I(i,j) \rceil-\lfloor I(i,j) \rfloor}<M(i \bmod n,\ j \bmod m),\\ \lceil I(i,j) \rceil, & \text{otherwise.}\end{cases}$$

For color images that contain three components R, G and B, spatial dithering can be carried out independently for all the three components.

There are two different classes of dithering masks, one is dispersed dot mask and the other is clustered dot mask. Dispersed dot mask is preferred when accurate printing of small isolated pixels are reliable, while the clustered dot mask is used when the process cannot accommodate the small isolated pixels accurately. According to an embodiment of the present invention, because the display is able to accurately accommodate the pixels, dispersed dot masks are utilized. The threshold pattern of dispersed dot mask is usually generated such that the generated matrices insure the uniformity of the black and white across the cell for any gray level. For each gray level, the average value of the dithered pattern is approximately same as the gray level.

Luminance Preserving Quantization

The problem of color quantization to true RGB color space is to find an 8-bit RGB triple to represent the higher precision rgb values. The common practice for color quantization is to round an original rgb value to its nearest RGB quantization level. However, because the human eye is much more sensitive in luminance than chrominance, the quantization errors from simple rounding are perceptually non-uniform for luminance and chrominance components. Luminance preserving quantization attempts to minimize the luminance difference between the input and output colors, while keeping the chrominance difference within a tolerable range.

A simple implementation is as follows. The main idea is to vary the RGB value in a small range defined as: $\{[R,G,B]^T | R \in \{\lfloor r \rfloor, \lceil r \rceil\}, G \in \{\lfloor g \rfloor, \lceil g \rceil\}, B \in \{\lfloor b \exists, \lceil b \rceil\}\}$ to minimize the luminance difference between input and output colors, where $\lfloor \bullet \rfloor$ is the nearest quantization level that is less than or equal to •, and $\lceil \bullet \rceil$ is the nearest quantization level that is greater than •. In other words, the [R,G,B] can take values only at the eight vertices of the unit cube that contains high precision value $[r,g,b]^T$. Then, the minimization can be e.g. as:

$$\begin{bmatrix}R\\G\\B\end{bmatrix}=\arg\min_{\substack{R\in\{\lfloor r \rfloor,\lceil r \rceil\}\\ G\in\{\lfloor g \rfloor,\lceil g \rceil\}\\ B\in\{\lfloor b \rfloor,\lceil b \rceil\}}}\left\|M_1\cdot\begin{bmatrix}r-R\\g-G\\b-B\end{bmatrix}\right\|,$$

where $M_l$ is the coefficient to calculate the luminance value y as: n,m<<h,v, where:

$$y = M_1 \cdot \begin{bmatrix} r \\ g \\ b \end{bmatrix}.$$

Figure 8:
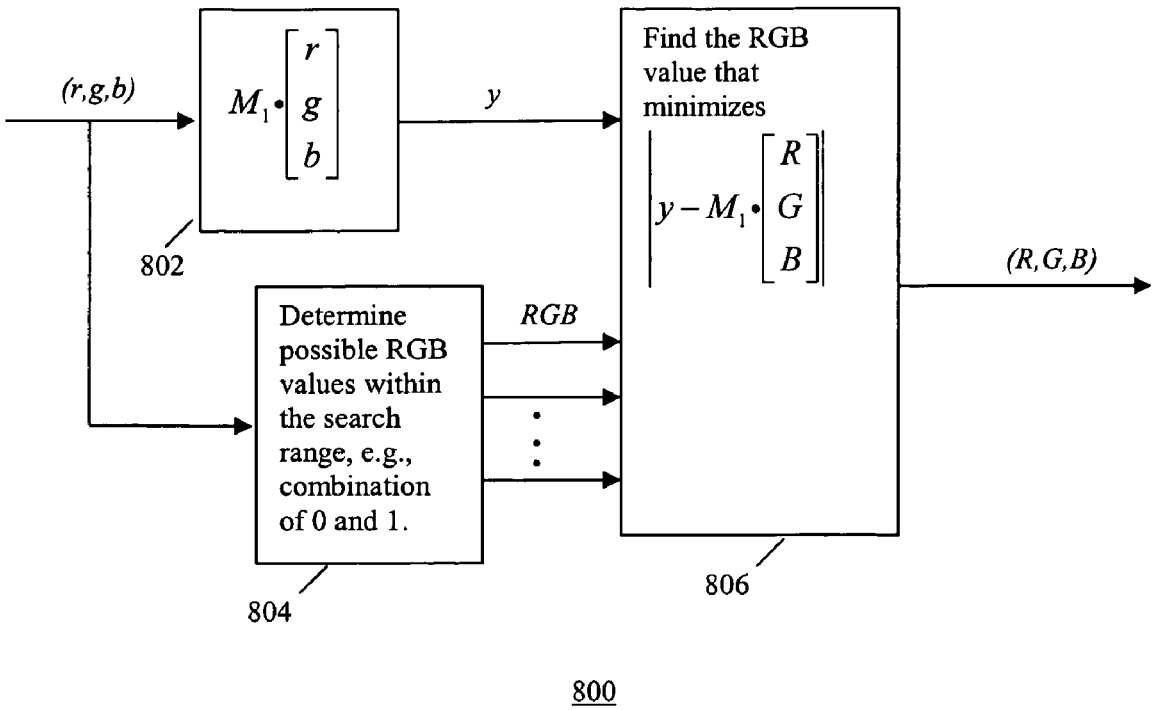
FIG. 8 shows an example system implementing a luminance preserving quantization method.

This minimization problem can be solved by an exhaustive search wherein the resulting images from the quantization method contain color values that have higher precision on luminance value. FIG. 8 shows an example block diagram of a system 800 for luminance preserving quantization, which implements the above steps. The RGB values of the input are manipulated to minimizing the luminance difference of the input color and the output color. From the input (r,g,b), the luminance value y is determined in the block 802. Further, in the block 804, values possible RGB values within a search range are determined from the input (r,g,b). The RGB values and the luminance value y are processed in the block 806 to determine (R,G,B), wherein the block 806 determines the RGB values that minimize:

$$\left| y - M_1 \cdot \begin{bmatrix} R \\ G \\ B \end{bmatrix} \right|.$$

Combining Luminance Preserving Quantization and Halftoning Methods

In one embodiment, the present invention combines the luminance preserving quantization, together with the halftoning methods. Accordingly, the resulting quantization scheme will not only consider the spatial low pass property of human eyes, but also take account of the fact that human eyes are more sensitive in luminance than in chrominance. However, the two different categories of halftoning methods need different consideration of how to combine them with luminance preserving quantization.

Figure 6:
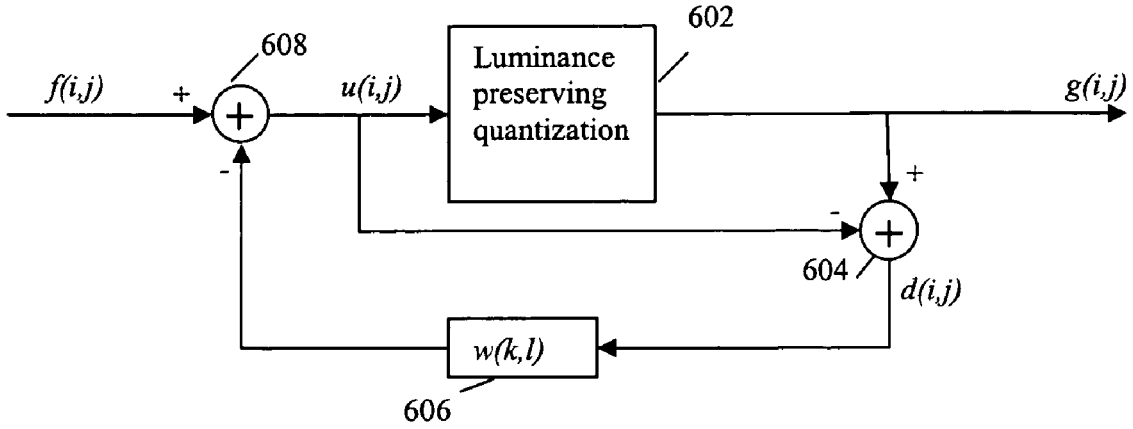
FIG. 6 shows an example combination of luminance preserving quantization and error diffusion.

Referring to FIG. 6, an example system 600 that combines luminance preserving quantization and error diffusion according to the present invention is now described. The input image to be processed is represented by an h×v matrix I of input gray levels I(i, j). A pixel value I(i,j) is first normalized to f (i,j) where $0 \leqq f(i,j) \leqq 1$. In the system 600 of FIG. 6, u(i,j) is the updated pixel value, and g(i,j) is the output of a luminance preserving quantization block 602 from u(i,j). The quantization error d(i,j) is computed by an adder 604 as:

$$d(i,j)=g(i,j)-u(i,j).$$

Then, the quantization error d(i,j) is distributed to it's neighboring pixels that are not processed yet, and the neighboring pixel's color value is updated using a w(k,l) weight block 606 and an adder 608 as:

$$u(i+k,j+l) \leftarrow u(i+k,j+l)-w(k,l)\cdot d(i,j),$$

with the weight w(k,l) shown by example in FIG. 2.

In the system 600 of FIG. 6, for each pixel, a best quantization is found in the block 602 such that the luminance difference between the updated pixel color u(i,j) and the quantized color g(i,j) is minimized. The quantization errors d(i,j) of both luminance and chrominance of this pixel are distributed to the neighboring pixels that are not processed yet. The error distribution strategy is same as the error diffusion method.

An example combination of luminance preserving quantization and spatial dithering according to the present invention is now described. In order to understand this combination, the steps of spatial dithering are explained in a different way. For each pixel I(i,j) and corresponding threshold T, dithering includes thresholding as:

$$O(i, j) = \begin{cases} 0, & \text{if } I(i, j) < T, \\ 1, & \text{otherwise.} \end{cases}$$

The thresholding can be noted as a function $P_T$:[0,1]↦{0, 1}. This could be explained as a two-step process: (1) a mapping $Q_T$:[0,1]↦[0,1] and (2) simple rounding R:[0,1]↦{0,1}, such that $P_T(\bullet)=R(Q_T(\bullet))$. Any mapping that maps T to 1/2, [0,T] to [0,1/2] and [T,1] to [1/2, 1], is eligible for the mapping $Q_T$. An example of spatial dithering in the viewpoint is shown by system 400 in FIG. 4, wherein a threshold is used to generate a mapping from an input value to an output value, and then the output value is simply rounded. Specifically, a mapping block 402 performs mapping as $Q_T$: [0,1]↦[0,1], and a rounding block 404 performs rounding as R:[0,1]↦{0,1}.

Figure 5:
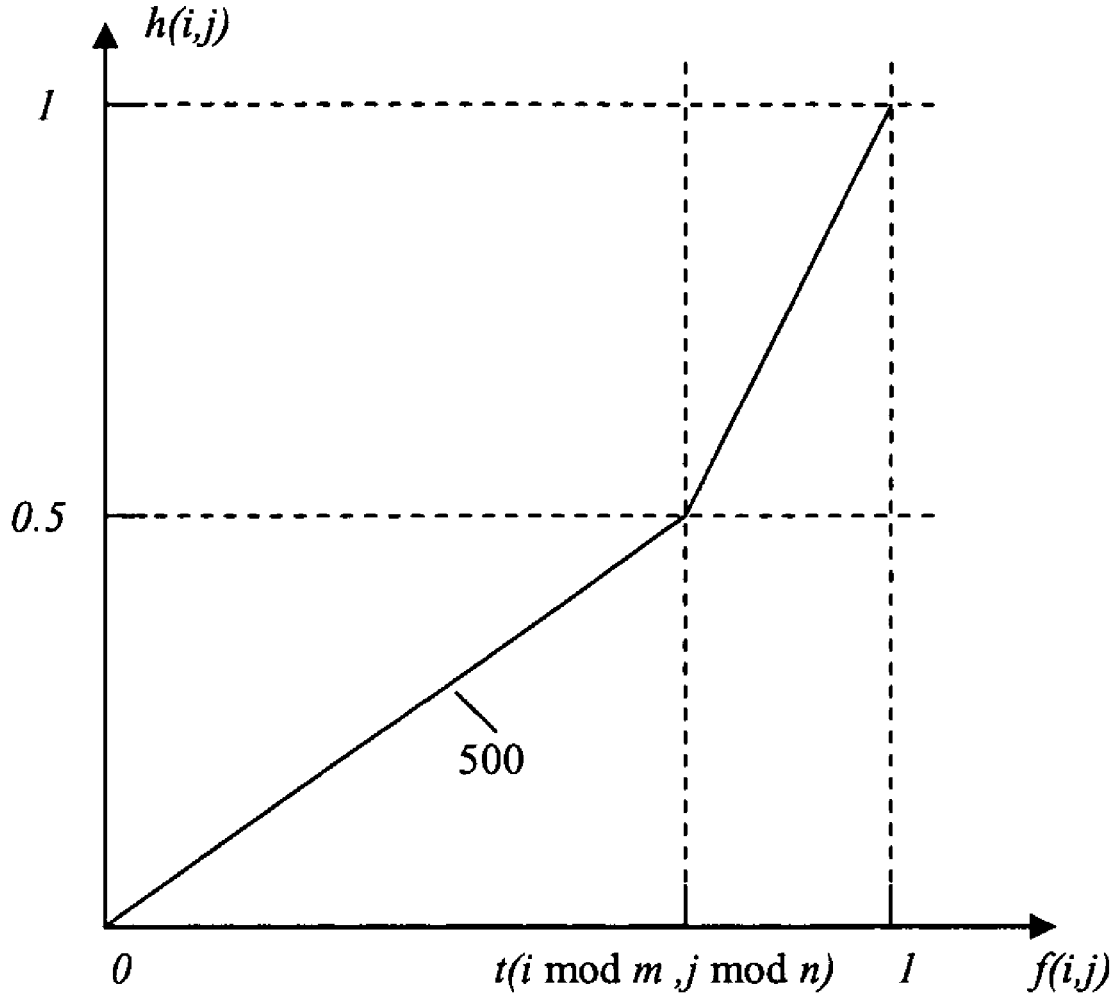
FIG. 5 shows an example curve of mapping generated by thresholding in FIG. 4.

An example mapping that eligible for the mapping $Q_T$ is shown in FIG. 5 as a piecewise linear mapping 500, which can also be represented as:

$$Q_T(v) = \begin{cases} \dfrac{v}{2T}, & \text{if } v < T, \\ \dfrac{v+1-2T}{2-2T}, & \text{otherwise.} \end{cases}$$

FIG. 5 provides a piecewise linear mapping wherein the threshold is mapped to 0.5, while 0 and 1 are mapped to 0 and 1, respectively.

Figure 4:
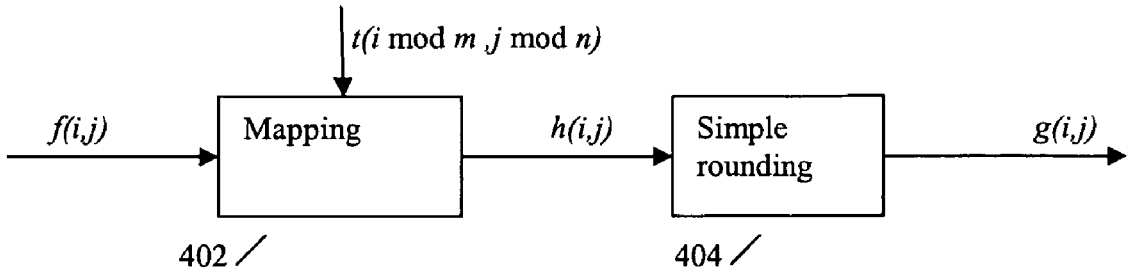
FIG. 4 shows an equivalent system for the example spatial dithering system in FIG. 3, wherein the threshold is used to generate a mapping, whose output is simply rounded.
Figure 7:
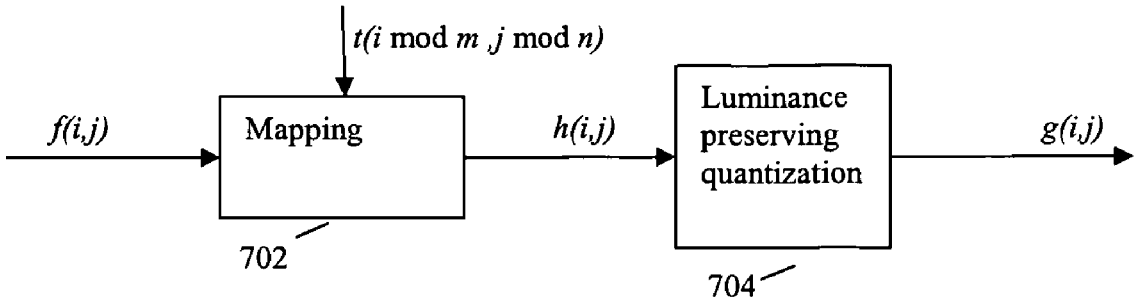
FIG. 7 shows an example combination of luminance preserving quantization and spatial dithering.

To combine luminance preserving quantization and spatial dithering, the rounding block 404 in the system 400 of FIG. 4 is replaced with luminance preserving quantization block 704 in the example system 700 of FIG. 7 in which mapping is performed by the mapping block 702.

Post-Processing for Reducing Color Tint

The above example methods of combining luminance preserving quantization and halftoning methods according to the present invention provide much smoother perceptual image. However, in case a small amount of perceptible color tint exists where the original image is intended as grayscale, the following example post-processing technique can be applied. For still images shown on a display, colored dithering patterns may be perceived. In order to reduce the color tint (relying on temporal property of the human eyes), the color tint of the luminance preserving quantization values is rotated such that the gray scale is perceived as gray scale.

Assume that pixel f(i,j) at kth frame (k mod 3=0) has input value r, g, b, (i.e., f(i,j,k)={r,g,b}) and the output is g(i,j,k){$=R_0,G_0B_0$}, where $R_0=\lfloor r\rfloor+dr, G_0=\lfloor g\rfloor+dg$ and $B_0=\lfloor b\rfloor+db$, wherein the same pixel in the next two frames, frame k+1 and frame k+2, should be assigned as:

$$R_1=\lfloor r\rfloor+dg, G_1=\lfloor g\rfloor+db \text{ and } B_1=\lfloor b\rfloor+dr,$$

and $$R_2=\lfloor r\rfloor+db, G_2=\lfloor g\rfloor+dr \text{ and } B_2=\lfloor b\rfloor+dg.$$

In this case, the still gray scale pixel will be perceived as gray scale pixel as the average R, G, B value of the three frames are:

$$\lfloor r\rfloor+(dr+dg+db)/3=\lfloor g\rfloor+(dr+dg+db)/3=\lfloor b\rfloor+(dr+dg+db)/3.$$

As such, the increments computed by luminance preserving quantization for each color component, dr, dg and db, are rotated in the neighboring three frames.

The present invention has been described in considerable detail with reference to certain preferred versions thereof; however, other versions are possible. Therefore, the spirit and scope of the appended claims should not be limited to the description of the preferred versions contained herein.

What is claimed is:

1. A method of video processing, comprising:

employing a video processor for receiving a RGB color signal comprising RGB of a pixel and its spatial and temporal positions, the received RGB color signal having a first precision;

quantizing the RGB color signal into a quantized RGB color signal having a second precision lower than the first precision and a predetermined quantization level as a function of halftoning and luminance preserving quantization (LPQ) by mapping the RGB color signal to a mapped color pixel as a function of a spatially dependent dithering mask threshold and selecting the quantized RGB color signal that minimizes a difference of a luminance of the mapped color pixel and luminance values of predetermined quantized RGB color signals; and outputting the quantized RGB color signal at a quantization level based on the dithering mask threshold.

2. The method of claim 1 wherein quantizing the RGB signal into a quantized RGB signal having a predetermined quantization level further includes:

quantizing a color value of a pixel using luminance preserving quantization; and distributing quantization errors to neighboring unprocessed pixels using an error diffusion method.

3. The method of claim 1, wherein LPQ includes quantizing the RGB color signal such that a luminance of the received RGB color signal is essentially preserved in the quantized RGB color signal, wherein LPQ further includes essentially minimizing quantization errors in luminance of the received RGB color signal while ensuring that a difference in chrominance before and after quantization is constrained.

4. The method of claim 2 wherein quantizing the RGB signal into a quantized RGB signal having a predetermined quantization level further includes:

quantizing the mapped color using luminance preserving quantization.

5. The method of claim 2 wherein quantizing the RGB signal into a quantized RGB signal having a predetermined quantization level further includes:

mapping a color of a pixel as a piecewise linear mapping; and quantizing the mapped color using luminance preserving quantization.

6. The method of claim 4, wherein the dithering mask is a dispersed dot mask.

7. The method of claim 5 further comprising performing post-processing quantized RGB color signal which makes gray scale color still gray scale, before outputting the quantized signal.

8. The method of claim 7 further comprising rotating the color tint of the luminance preserving quantization values such that the gray scale is perceived as gray scale by a viewer.

9. A video processing system, comprising:

means for receiving a color signal comprising RGB of a pixel and its spatial and temporal positions, the received color signal having a first precision;

a quantizer that quantizes the RGB signal into a quantized RGB color signal having a second precision lower than the first precision and a predetermined quantization level as a function of halftoning and luminance preserving quantization (LPQ) by mapping the RGB color signal to a mapped color pixel as a function of a spatially dependent dithering mask threshold and selecting the quantized RGB color signal that minimizes a difference of a luminance of the mapped color pixel and luminance values of predetermined quantized RGB color signals; and outputting the quantized RGB color signal at a quantization level based on the dithering mask threshold.

10. The system of claim 9 wherein the quantizer quantizes the RGB signal into a quantized RGB signal having a predetermined quantization level by quantizing a color value of a pixel using luminance preserving quantization, and distributing quantization errors to neighboring unprocessed pixels using an error diffusion method.

11. The system of claim 9, wherein LPQ includes quantizing the RGB color signal such that a luminance of the received color signal is essentially preserved in the quantized RGB color signal, wherein LPQ further includes essentially minimizing quantization errors in luminance of the received color signal while ensuring that a difference in chrominance before and after quantization is constrained.

12. The system of claim 10 wherein the quantizer quantizes the RGB signal into a quantized RGB signal having a predetermined quantization level by mapping a color of a pixel as a function of a threshold, and quantizing the mapped color using luminance preserving quantization.

13. The system of claim 10 wherein the quantizer quantizes the RGB signal into a quantized RGB signal having a predetermined quantization level by mapping a color of a pixel as a piecewise linear mapping, and quantizing the mapped color using luminance preserving quantization.

14. The system of claim 13 further comprising post-processor that processes the quantized RGB color signal which makes gray scale color still gray scale, outputting of the quantized signal.

15. The system of claim 14 wherein the post-processor rotates the color tint of the luminance preserving quantization values such that the gray scale is perceived as gray scale by a viewer.

16. A method of video processing, comprising:

employing a video processor for receiving a color signal comprising RGB of a pixel and its spatial and temporal positions;

quantizing the RGB signal into a quantized RGB color signal having a predetermined quantization level as a function of halftoning and luminance preserving quantization by mapping a color of a pixel as a function of a dithering mask threshold; and outputting the quantized RGB color signal as a lower quantization level and an upper quantization level depending on the dithering mask threshold;

wherein quantizing the RGB signal into a quantized RGB signal having a predetermined quantization level further includes:

quantizing a color value of a pixel using luminance preserving quantization; and distributing quantization errors using error diffusion method;

quantizing the mapped color using luminance preserving quantization.

17. A method of video processing, comprising:

employing a video processor for receiving a color signal comprising RGB of a pixel and its spatial and temporal positions;

quantizing the RGB signal into a quantized RGB color signal having a predetermined quantization level as a function of halftoning and luminance preserving quantization by mapping a color of a pixel as a function of a corresponding threshold in a dithering mask and minimizing a difference of a luminance of the mapped color pixel and luminance values of predetermined quantized RGB color signals based on a selection of a quantized RGB color signal; and outputting the quantized RGB color signal at a quantization level based on the dithering mask threshold.

18. A method of video processing, comprising:

employing a video processor coupled to a quantizer for receiving a RGB color signal having a first precision comprising RGB of a pixel and its spatial and temporal positions;

mapping the RGB color signal to a mapped color pixel as a function of a spatially dependent dithering mask threshold;

selecting a quantized RGB color signal that minimizes a difference of a luminance of the mapped color pixel and luminance values of predetermined quantized RGB color signals, where a quantized RGB color signal has a second precision lower than the first precision, and the quantized RGB color signal is quantized such that a luminance of the received RGB color signal is essentially preserved in the quantized RGB color signal, and quantizing the RGB color signal includes essentially minimizing quantization errors in luminance of the received RGB color signal while ensuring that a difference in chrominance before and after quantization is constrained; and outputting the quantized RGB color signal.

19. A method of video processing, comprising:

employing a video processor coupled to a quantizer for receiving a RGB color signal having a first precision comprising a RGB pixel and its spatial and temporal positions;

combining the RGB pixel with a quantization error associated with previously processed RGB pixels to form an updated color pixel;

selecting a quantized RGB pixel that minimizes a difference of a luminance of the updated color pixel and luminance values of predetermined quantized RGB color signals, where a quantized RGB color signal has a second precision lower than the first precision, and the quantized RGB pixel is quantized such that a luminance of the received RGB color signal is essentially preserved in the quantized RGB pixel, and quantizing the RGB pixel includes essentially minimizing quantization errors in luminance of the received RGB color signal while ensuring that a difference in chrominance before and after quantization is constrained; and outputting the quantized RGB pixel.

* * * * *